United States Patent [19]

Riccio et al.

[11] Patent Number: 4,714,623

[45] Date of Patent: Dec. 22, 1987

[54] METHOD AND APPARATUS FOR APPLYING METAL CLADDING ON SURFACES AND PRODUCTS FORMED THEREBY

[76] Inventors: Louis M. Riccio, P.O. Box 81, DeVault, Pa. 19432; Alexander A. Bosna, 135 Summit Rd., Malvern, Pa. 19355

[21] Appl. No.: 829,047

[22] Filed: Feb. 13, 1986

Related U.S. Application Data

[60] Division of Ser. No. 706,989, Feb. 28, 1985, Pat. No. 4,618,504, and a continuation-in-part of Ser. No. 563,430, Dec. 20, 1983, Pat. No. 4,521,475, each is a continuation-in-part of Ser. No. 481,412, Apr. 1, 1983.

[51] Int. Cl.[4] ..... B05D 1/06; B05D 1/08

[52] U.S. Cl. ..... 427/27; 427/34; 427/54.1; 427/423

[58] Field of Search ..... 427/34, 54.1, 204, 290, 427/423, 27

[56] References Cited

U.S. PATENT DOCUMENTS

| | | | |
|---|---|---|---|
| 819,125 | 5/1906 | Coleman | 427/203 |
| 3,097,932 | 7/1963 | Goldheim | 427/423 |
| 3,144,349 | 8/1964 | Swingler et al. | 427/154 |
| 3,179,531 | 4/1965 | Kovbek | 427/423 |
| 3,325,303 | 4/1967 | Lant et al. | 427/203 |
| 3,476,577 | 11/1969 | Davie | 428/325 |
| 3,775,157 | 11/1973 | Fromson | 427/53.1 |
| 4,182,641 | 1/1980 | Fitts | 428/309.9 |
| 4,226,906 | 10/1980 | Jacob | 428/313.9 |
| 4,303,730 | 12/1981 | Torobin | 428/325 |
| 4,307,142 | 12/1981 | Blittstein et al. | 428/403 |

FOREIGN PATENT DOCUMENTS

| | | | |
|---|---|---|---|
| 22110 | 7/1978 | Japan | 427/290 |
| 135851 | 10/1979 | Japan | 428/313.3 |
| 33485 | 4/1981 | Japan | 427/423 |

*Primary Examiner*—John H. Newsome
*Attorney, Agent, or Firm*—Jim Zegeer

[57] ABSTRACT

Small, preferably micronsized hollow glass or ceramic or carbon spheres (or a mix thereof) sprayed into a uncured or wet resin material which is formed into a layer and after curing of the resin layer, it is abraded, sand or grit blasted so as to rupture the outermost layer of spheres or voids to provide a plurality of anchor sites undercuts or nooks and crannies. A thermally sprayed metal, such as copper, becomes embedded into the undercuts, nooks and crannies, such that the bond or adherent strength is greatly improved. This micronsized glass, ceramic carbon spheres and/or pores greatly increases the bond strength by providing better undercuts in the surface to be sprayed by molten metal and provide the capability of depositing thicker layers without jeopardizing the bond.

22 Claims, 26 Drawing Figures

FIG. 4
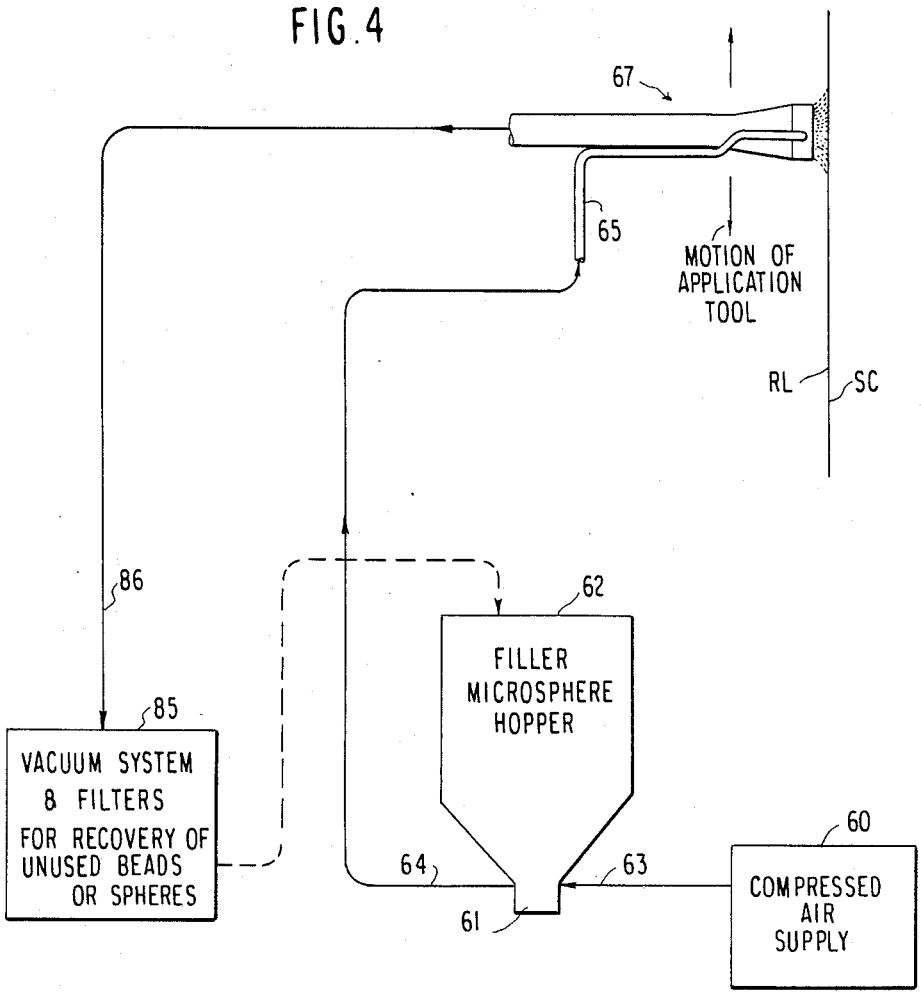
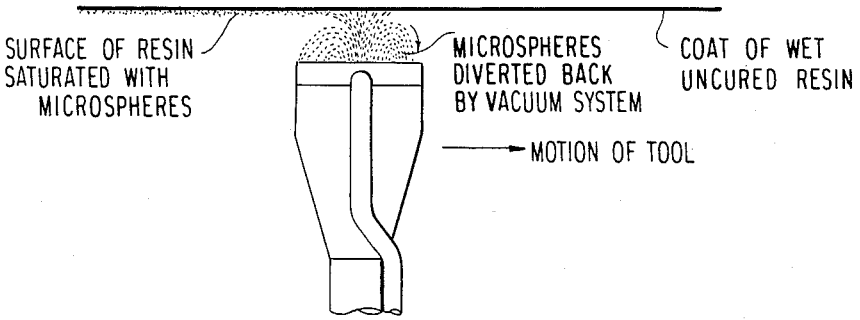
FIG. 8

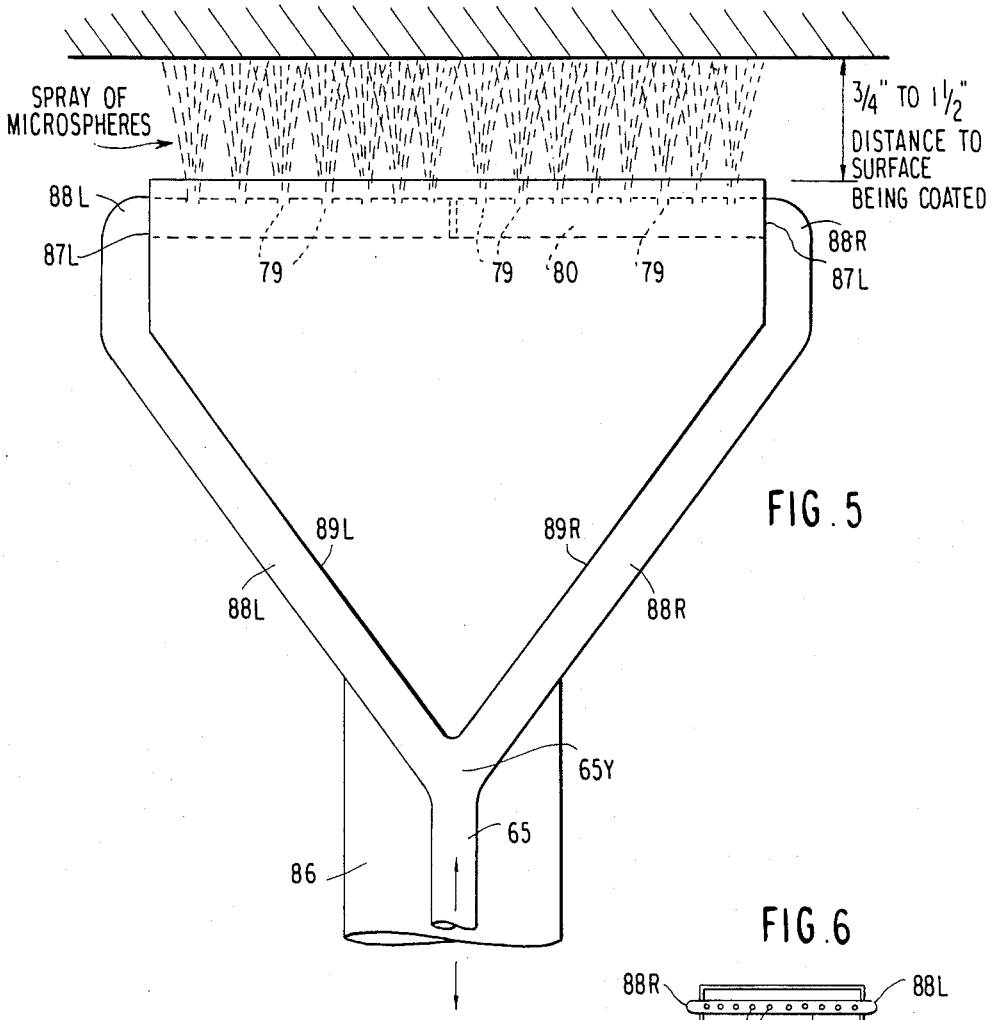
FIG. 5
FIG. 6
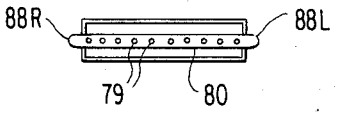
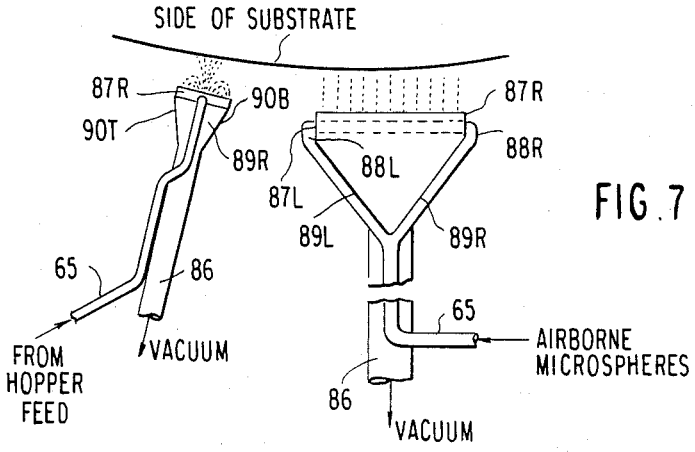
FIG. 7

FIG. 12a
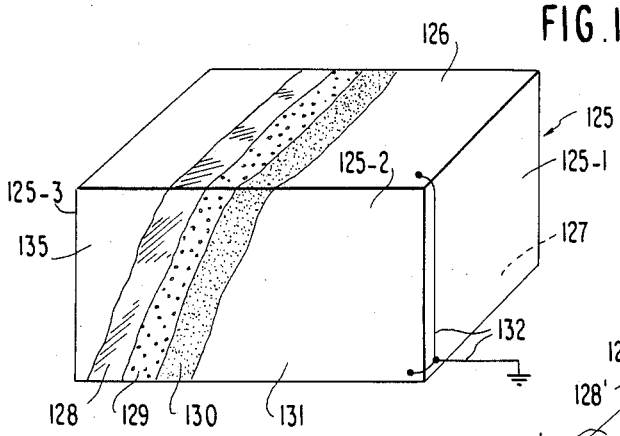
FIG. 12b
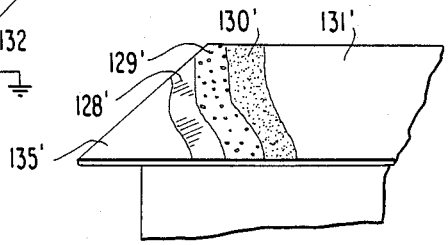
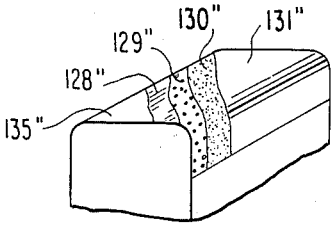
FIG. 12c
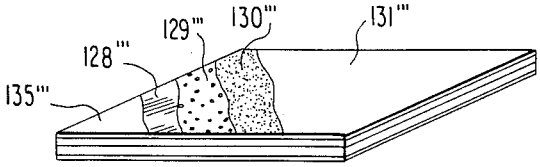
FIG. 12d
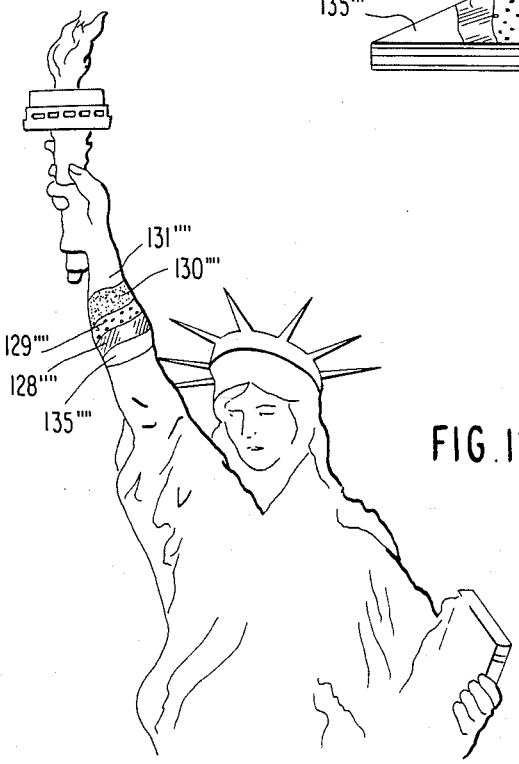
FIG. 12e FIG.13a
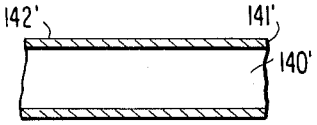
APPLY TIE COAT
ABRAID AND CLEAN
FIG.13b
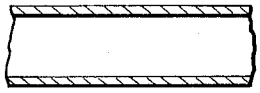
THERMALLY SPRAY
COPPER .005" THICK
FIG.13c
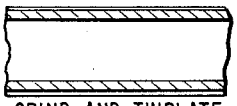
GRIND AND TINPLATE
FIG.13d
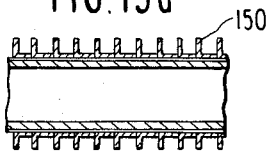
ASSEMBLE TIN PLATED
COPPER FINS
FIG.13e
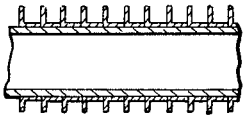
FLUX AND SOLDER
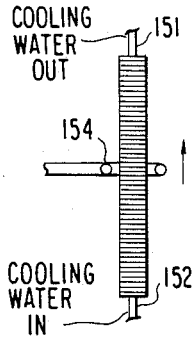
FIG.13f
INDUCTION OR
HOT AIR
SOLDERING
FIG.13g HOT OIL BATH
SOLDERING
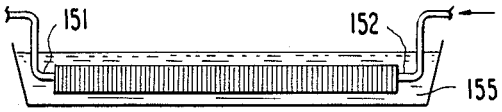
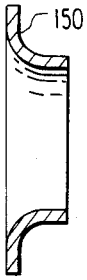
FIG.14a
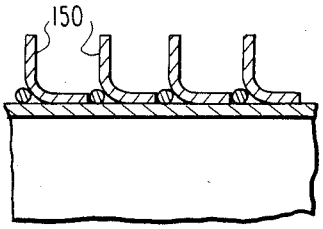
FIG.14b
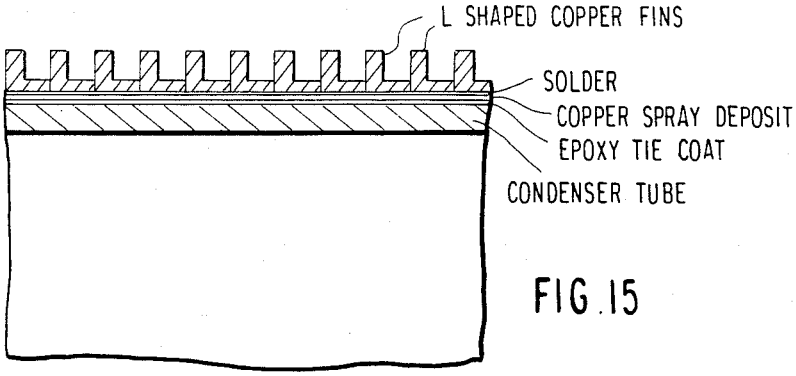
FIG.15

METHOD AND APPARATUS FOR APPLYING METAL CLADDING ON SURFACES AND PRODUCTS FORMED THEREBY

RELATED APPLICATIONS

This application is a continuation-in-part of our application Ser. No. 563,430, filed Dec. 20, 1983, now U.S. Pat. No. 4,521.475, and our divisional application Ser. No. 706,989, filed Feb. 28, 1985, now U.S. Pat. No. 4,618,504 both of which are continuation-in-parts of our application Ser. No. 481,412, filed Apr. 1, 1983.

BACKGROUND AND BRIEF DESCRIPTION OF THE INVENTION

The application of metal coatings to various surfaces by means of thermally sprayed molten metal particle is well known in the art. The application of anti-fouling metal coatings using the thermal spraying technique to marine structures, particularly hulls of boats and ships, is known, see Japanese Patent Document No. 56-33485 of April 1981. The process is also applicable generally to such exemplary structures as underwater pilings, power plant intake ducts, underwater energy conversion systems, buoys, off-shore drill platforms and the like where the fouling by marine growth interferes with or impedes the efficient operation of such apparatus.

Various systems have been devised for applying anti-fouling substances, typically copper and copper alloys, to marine surfaces, these include copper foils, panels or tiles which are adhered to hull surfaces. The most modern of these are paint and coating technologies which depend on uniform consumption of the binder and toxin and biocide and therefore are limited by the thickness or number of coatings applied. In the tile or foil methods, painstaking tailoring of individual panels or tiles to the complete hull surfaces has, in general, not been found acceptable by the marine trades. In Japanese Patent Document No. 56-33485 of April 1981, copper and copper alloy are thermally sprayed on a prepared resin bond coating, which may incorporate talcum, mica or fiberglass to provide antifouling protection for hulls, etc.

The present invention provides a distinct improvement over the art in that this invention includes, in a preferred embodiment, applying a curable adhesive layer onto the surface to be coated, spraying hollow glass, ceramic or carbon spheres or beads (and even phenolis beads or spheres) in the micronsize range (these microspheres are marketed under various trademarks such as Microballoons TM) onto the uncured adhesive layer, preferably so as to saturate the adhesive layer and then curing the adhesive layer. In some cases, the microsopheres can comprise a mix of glass and ceramic, or glass and carbon, or ceramic and carbon or glass, ceramic and carbon spheres, the ratios being tailored to the particular application. Thereafter the hollow beads and adhesive layer is abraded to rupture the hollow spheres and thermally sprayed with molten metal particles in one or more passes to form the metal layer. The adhesive layer can be a resin, preferably an epoxy which serves as the sealing layer, and firmly adheres the thermally sprayed metal coating. The mechanism is relatively simple in that the heavily filled resin layer is abraded by sanding or orit blasting sufficient to rupture, sheer and/or fracture the embedded hollow spheres. After the abrading process is completed, the surface is vacuumed or power-washed clean to remove the abraded material so that the surface now represents a porous surface with a matrix of large numbers of undercuts, nooks and crannies. The thermal spray process can employ either an oxygen/acetylene flame, electric arc to melt copper/nickel wire or combinations of these well known processes of spraying metal. The molten metal is atomized by compressed air into fine particles and propelled to the substrate. These particles are sufficiently hot and ductile to deform and embed themselves into the undercuts and recesses of the modified epoxy layer forming a strong mechanical bond. Sufficient passes build the deposit to a desired thickness. The sprayed molten metal, such as copper or copper based alloys for anti-fouling purposes flows into the undercuts, nooks and crannies and now becomes embedded into and mechanically locked to these pores and in this manner, the bond strength is mechanically fixed. The anti-fouling system includes a resin layer which could be a polyurethane a polyester or epoxy resin which serves three main functions: (1) provides an adhesive between the marine surface and a spray deposited copper or copper coating and (2) a seal layer to seal fine cracks in the gel coat of a fiberglass hull, for example, and (3) to prevent osmosis and a dielectric layer in the case of a steel hull to prevent electrolytic corrosion effects.

Spraying the hollow spheres or beads on the adhesive resin coating or layer provides a smooth uniform coating with less effort and process time, and the application of the resin layer, spraying with hollow spheres or beads, abrading or grit blasting and thermally spraying can all be easily automated. Spraying the spheres according to the invention can be on vertical as well as on overhead surfaces with equally advantageous results.

BRIEF DESCRIPTION OF THE DRAWINGS

Other objects, advantages and features of the invention will become more apparent when considered in light of the following specification and accompanying drawings wherein:

FIG. 2 is an enlarged sectional view showing undercuts, nooks and crannies and the filling of same with a copper/copper alloy type metal for cladding marine surfaces and the like.

FIG. 4 illustrates micronsized hollow beads or sphere spray and recovery system incorporated in the invention.

FIG. 5 is a top plan view of microspheres spray and recovery nozzle incorporating the invention.

FIG. 6 is an end view showing a row of microspheres issuing orifices and the vacuum recovery entranceway.

FIG. 7 is a side view of a substrate showing side and top operational aspects of the microsphere spray and recovery nozzel of FIG. 5.

FIG. 8 is a view illustrating the microsphere blowing and vacuumizing operation of the nozzle.

FIG. 12*a* illustrates a room or bulky structure in which the walls, ceilings, and if necessary, floors have been coated with a copper coating according to the invention for EMI or RFI purposes.

FIG. 12*b* illustrates a roof which has a metal coating, such as copper, applied using this invention.

FIG. 12*c* illustrates a cornice incorporating the invention.

FIG. 12*d* illustrates a sheet of plywood or component structures incorporating the invention which can be used for any building purpose.

FIG. 12*e* illustrates a sculpture, which may be a plaster, concrete. cement, plastic or even foam casting which has had a coating of metal, such as bronze or copper, applied according to the invention.

FIGS. 13*a*–13*g* illustrate another use of the invention in the manufacture of light weight heat exchanger apparatus.

FIGS. 14*a* and 14*b* illustrate a further application of the invention to the manufacture of gromet type fins, and FIG. 15 is an enlarged section of a heat exchange tube for a condenser incorporating the invention.

DETAILED DESCRIPTION OF THE INVENTION

Applying metallic coatings on surfaces by thermal spraying is not, per se, new as is shown in the above noted Japanese patent publication. Swingler et al U.S. Pat. No. 3,144,349, and in Miller U.S. Pat. No. 4,078,097. The thermal spray processes include melting powder in an electric or oxyacetylene arc and using compressed air or inert gas to propel the molten particles toward the substrate at a high velocity. Another form of thermal spray is the plasma arc whereby the powder or wire introduced into a high-velocity plasma arc created by the rapid expansion of gas subjected to electric arc heating in a confined volume. Another thermal spray process that is used is the combustion of oxygen and fuel in a confined volume and its expansion through a nozzle provide the high velocity flow into which metal powder is introduced coincidental with the projected gas stream. According to this invention, the mechanism of attachment is that molten particles of copper which can be travelling at hypersonic speeds, greater than 5 times the speed of sound or estimated at 6,000 feet per second (with certain types of equipment) are hot and ductile will flow and deform and embed themselves into and mechanically lock with the undercuts, nooks and crannies and the first layer forms the basis upon which subsequent layers of metal can be deposited to build-up to a desired thickness. The molten particles of metal forced into the nooks, crannies and undercuts and roughness of the surface produces a much stronger and more dense flexible layer of cladded metal which, in the case of copper or copper based alloys, are very useful in providing very long term marine anti-fouling surfaces.

Marine piping made of concrete, steel, etc., which are exposed to fouling, can easily have the internal surfaces thereof treated according to the process of this invention to reduce and eliminate flow impeding growths.

Figure 1:
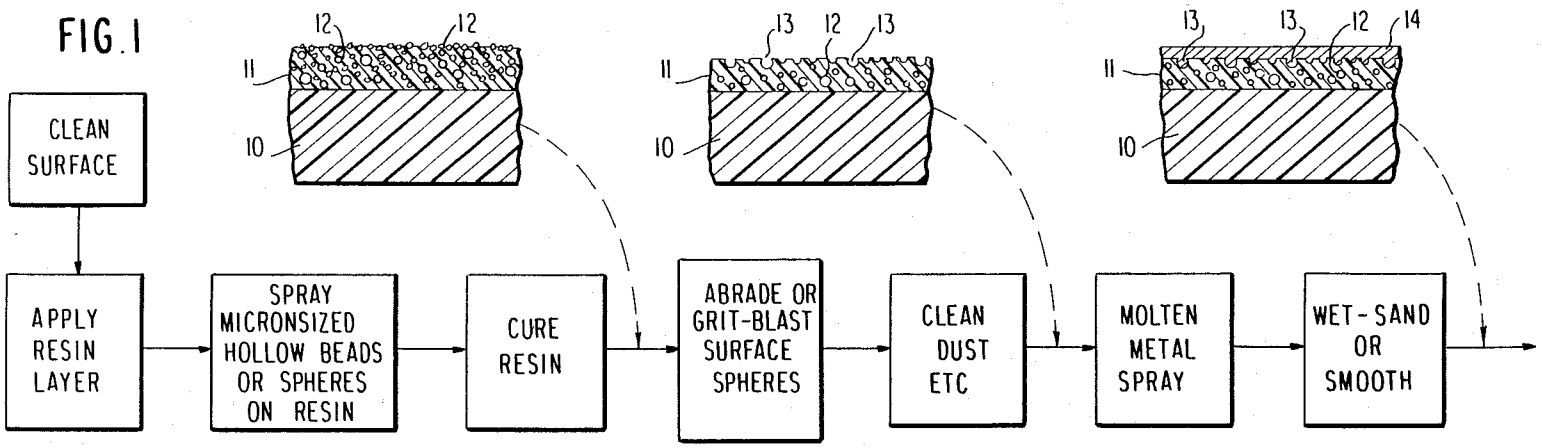
FIG. 1 is a block diagram illustrating the basic steps of the metal clading process according to the invention, the balloons are enlargements of cross-sections of the product as it emerges from each of the indicated steps of the process.
Figure 2:
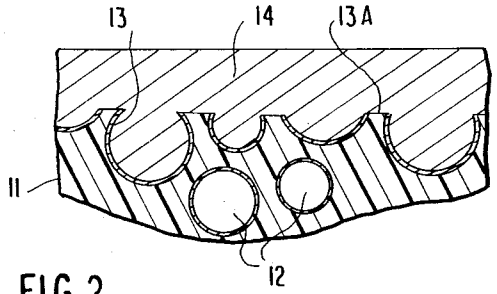

As shown in FIG. 1, the initial step of applying a coating of copper or copper alloy to a substrate surface such as a marine hull is surface preparation. After surface preparation, a curable resin coating, preferably on eboxy, is applied followed by spraying the uncured resin with micronsized hollow spheres or beads of glass or ceramic until the eboxy is saturated with the spheres or beads, which is indicated by a dull matte finish. Then the bead or sphere filled resin is cured and then abraded or grit-blasted to fracture or rupture the surface ones of said beads or spheres to form the matrix of undercuts, nooks and crannies to subsequently receive the thermal spraying of copper and/or copper alloys.

For the conventional gel coat of a fiberglass hull, for example, the grit blasting is with No. 120-80 grit silicon oxide, silicon carbide, or aluminum oxide to remove the high polish of the finish so that it has a matte appearance wherein microscopic pits, pores and crevaces in the gel coat are exposed and depending upon the character of the blast media, various forms of undercuts are made in the surface. It will be appreciated that surface preparation must not unintentionally alter the structural integrity and hydrodynamic surface of the hull or structure or object being coated. Surface preparation consists of removing mold release agents and other foreign matter from the surface of a new hull. The invention can be applied to any properly prepared metal, wooden or ferro-cement surface. For example, statuary or sculpture, such as the bust shown in FIG. 12*e*, can be molded of a plaster of paris or even clay base, coated with an epoxy resin, sprayed with glass or ceramic microspheres, abraded by grit blasting and then thermally sprayed with a bronze metal.

A resin or gel layer 11 is uniformly applied over the prepared surface by brush, towel, spray or roller. As noted earlier, prior to curing the resin or gel layer is sprayed, preferably to saturation with micronsized glass or ceramic spheres 12. In one preferred practice, illustrated and described in relation to FIGS. 4 and 5 hereof, the spheres are applied by uniform low pressure micronsized bead or sphere spray and recovery equipment so as to not prematurely damage the spheres and not distort the uniform resin coating and substrate surface. The micronsize spheres will be uniformly dispersed on the resin layer so that when orbit blasted or abraded to form the matrix of undercuts. nooks and crannies and which is sprayed with molten copper, superb mechanical adhesion was achieved. The resin is cured and then abraded or orit-blasted sufficiently to shear and fracture or rupture the surface ones of the embedded spheres to provide numerous undercuts, crevices, nooks and crannies 13. This forms a matrix of undercuts, nooks and crannies into which the molten metal flows on impact, and, upon solidification, mechanically interlock the metal layers to the surface to be protected. This porous surface is then vacuumed or power cleaned and the molten metal 14 sprayed thereupon.

In a preferred embodiment, the micronsized spheres, in graded sizes range from about 10 to about 300 microns and larger, the larger size ranges being preferred.

A micro sphere spray and recovery system is disclosed in FIG. 4 for uniformly applying the microspheres to a substrate surface SC which has been coated with a resin layer RL by brush, roller or spray. The apparatus of FIG. 4 sprays operates while the resin layer RL is still wet or uncured. The resin layer RL is saturated with microspheres to produce a dull matte or unshiny appearance. The surface is visually inspected after a few minutes, wet or shiny surfaces are re-sprayed to a dull matte surface. The apparatus includes a compressed air supply 60 connected by line 63 to a conventional powder feed 61 at the bottom or lower end of microsphere hopper 62. Air borne microspheres leave the powder fill mechanism 61 via flexible hose line 64 which conveys the air borne microspheres to coupling 65 for pipe 66 on microsphere spray and recovery nozzle 67. Air carrying the microspheres is at relatively low pressure and exists from a row of orifices 79 in sphere or bead manifold distribution and spray tube 80.

The low pressure of air carrying or impelling the microspheres is just sufficient to carry the microspheres to impinge or the still wet resin surface RL. Excess microspheres recovery is achieved by a vacuum system 85 which includes having conventional filters for recovery of the micronsized spheres. The vacuum or negative air pressure is coupled to microsphere spray and recovery nozzle or tool 67 by a conventional flexible vacuum hose 86. As shown in FIG. 5, the microsphere recovery nozzle includes a pair of short parallel side walls 87L and 87R through which pass the lateral ends 80L and 80R of microsphere spray tube 80, which in turn are connected by tubes 88L and 88R to a Y joint 65Y at the end pipe 65 and the supply of air borne microspheres. The ends of sidewalls 87L and 87R are joined to converging sidewalls 89L and 89R which converge to join with vacuum line 86. The vacuum nozzle is coupled by converging top and bottom walls 90T and 90B respectively, which likewise converge to join vacuum line 86.

The nozzle is held a distance of ¾" to about 1½" from the surface still wet or uncured and moved at a relatively uniform rate of speed to assure uniform dispersal of the microspheres and until the resin has a dull matte finish. The resin surface is visually inspected after a few minutes and any "shiny" or wet appearing surfaces are preferably resprayed to a dull matte surface.

Any microspheres which fail to reach the resin surface or which bounce off the surface either because the resin at a given point is saturated with the beads or spheres or for any other reason, are sucked up by the vacuum nozzle, recovered and if desired, returned to microsphere hopper 62.

Small objects which have intricate curves, indentations, reintrant portions and the like, such as statuary and decorative moldings, may be dipped in a resin and sprayed or otherwise coated with the microspheres, the resin cured, grit-blasted and then thermally sprayed with the molten metal particles.

A further method of applying the matrix of micronsized spheres which maintains surface fidelity and has a high production rate is to apply a coat of conductive epoxy on the surface. While this is still wet and sticky, apply the micronsized hollow beads or spheres using an electrostatic discharge gun. This type of equipment places a charge on each micronsized sphere and it would be attracted to the surface of the conductive epoxy layer that forms part of the electrical loop or ground as a vacuum recovery system may not be needed.

The particles at first become engulfed and then would saturate the surface uniformly because by its very nature, when an area is coated the particles will tend to be drawn to an area that is not coated. After a couple of passes, the surface should be saturated with the filler micronsized spheres. When the epoxy sets up or cures (curing can be accellerated by U.V. or heat for certain resins), the surface can be given a light grit blast with a fine abrasive. This will remove the particles that are only marginally attached and break the ones on the surface that will provide the matrix of undercuts, nooks and crannies. After the light grit blast, the surface is power washed, dried and then sprayed with the copper-nickel alloy for antifouling or any other metal. This will provide a smoother uniform coating with less effort and process time.

It will be appreciated that surfaces which are not desired to have a cooper coating, such as above the water line of a marine hull, can be protected by masking tape 59, etc. The metal coating lever is preferably uniform but this is not necessary. In fact, in areas where there may be heavy mechanical wear or erosion, such as on the keel, bow and rudder areas, the metal layer can easily be made slightly thicker just by spraying additional layers in those areas. In some cases it may be desireable to add a second resin coating, spray with microspheres, abrade and thermal spray again with metal so as to produce two distinct metal layers separated by a resin layer.

Several different types of hollow glass and ceramic beads or sheres have been utilized. These were from the 3M Company. Emerson Cummings Corp., PQ Corporation, Micro-Mix Corporation, and Pierce and Stevens Chemical Corporation. Those varied in size from 5 to 300 microns. The coarser sizes are preferrable, it was found that the sprayed copper deposits adheres very well on practically all sizes, even blends of various hollow spheres give excellent results in proportions varying from about 20 percent to 200 percent by volume. It is desireable that at least a layer of the micronsized glass or ceramic spheres be at the surface. In the preferred practice of this invention, the resin is heavily filled or saturated, (in one preferred embodiment, 150 to 250 percent by volume of micronsized spheres relative to the amount of resin with 300 percent or 2:1 range being most preferred) and thus has thixotropic properties such that the spheres stay fixed, which is advantageous on vertical surfaces. A mixture of glass and ceramic micronsized spheres can be used in practicing the invention.

Figure 9:
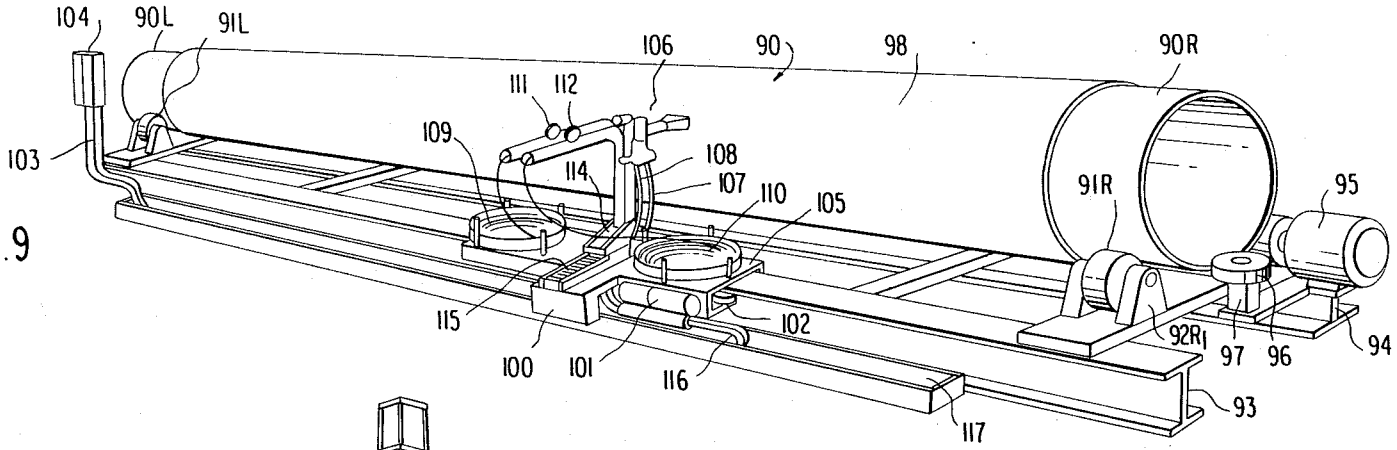
FIG. 9 is an isometric view of a automated pipe coating apparatus incorporating the invention.

In a preferred practice of the invention, the copper/-copper alloy metal coating 12 is applied in at least two passes of the thermal spray apparatus. In the first pass, the copper particles travelling at high speed splatter and flow into the undercuts, nooks and crannies 13 and fill the surface porosity with molten metal to provide a firmly secured rough layer that avoids detachment and delamination with the undercuts, nooks and crannies thereof providing strong mechanical adhesion and a firm base to which sprayed molten metal applied on the second pass becomes firmly secured. In a preferred practice of the invention, the metal is applied to a thickness of about 3 to 12 mils but it will be appreciated that greater or lesser thicknesses can be applied. For a commercial ocean going vessel, 12 to 15 mil (or more) thickness should last for about 15 years or longer, which would provide significant reduction in overall cost of application relative to lower initial cost paint based antifouling systems. After the final copper or copper alloy is applied, the external surface can be smoothed by light wet sanding to remove small protections, edges and produce a smoother hydrodyanmic surface. It will be appreciated that a single pass of the thermal spray apparatus can be used in many instances, and, further the rate of movement of the spray apparatus relative to the surface can be varied to vary the thickness of applied metal. Moreover, as shown in FIG. 9, the thermal spray apparatus can be moved on a horizontal track and the surface to be coated with metal moved relative thereto.

According to this invention, the resin, filled with hollow ceramic or glass spheres is allowed to cure, and in some cases, the curing is enhanced by the use of a U.V. durable resin.

Commercially pure copper and copper-nickel alloys are preferably used in the practice of the invention for antifouling purposes. Depending on the thermal metal spraying apparatus used, commercially pure copper and/or nickel-copper alloys (90–94 percent copper and 10–6 percent nickel. With a 90 percent copper, 10 percent nickel alloy CD#706 being preferred) in the form of wires or powders are used in the practice of the invention. As noted above, in the preferred practice of the invention, the copper base metal and antifouling layer is applied in at least two passes. One would not go beyond the invention in using two different types of thermal spray apparatus during each pass, it being appreciated that it is during the first that the molten particles of copper, traveling at high speeds, will attach and embed themselves in the undercuts, nooks and crannies 13, seal layer 11. During the second pass the molten particles are forced into the undercuts and roughness of the surface left from the previous pass. Preferably the coating applied in the initial or first pass in thinner than in the second and succeeding passes. This thin metal coating provides an excellent base for receiving and securely bonding the thermally sprayed second pass.

In some cases, other constituents. such as dyes, solid state lubricants (to reduce friction) and other biocides can be blended into the copper and/or copper-nickel feed powders.

Copper is softer than copper-nickel alloy, if the use of the area of the boat or ship is such that high abrasion resistance is required, the final thermally sprayed metal layer preferably will be copper-nickel alloy.

In the course of perfecting this invention, various resins were tried and they all worked almost equally well from the adherence standpoint. The final selection is dictated by the type of surface to be treated. For instance, polyester resin is preferred for fiberglass hulls since it more closely matches the polyester gel coats already present. However, more recent expert opinion indicates the use of epoxy resin for better underwater service and strength. The final thermally sprayed metal coat can be lightly wet sanded as is the practice with racing yachts to produce a smoother surface.

Figure 3:
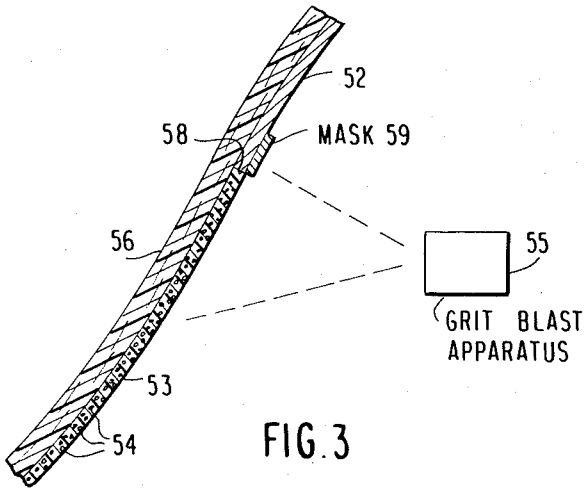
FIG. 3 illustrates a portion of a hull of a marine vessel incorporating the invention.

As shown in FIG. 3, the hull 56 of a marine vessel has the end 58 of get coat 52 masked by masking tape 59. An epoxy layer 53 which has been sprayed with a microsphere 54 is being grit-blasted by grit-blast apparatus 55 to fracture the microspheres and create a matrix of undercuts, nooks and crannies, which, after power washing is ready for the thermal spray of the desired metal coating, which for antifouling purposes is the copper or copper based alloys discussed above.

Instead of metal coating, the fractured or crushed voids bound in a resin matrix may be used as an adherent surface for any other coating or lamina.

Figure 10:
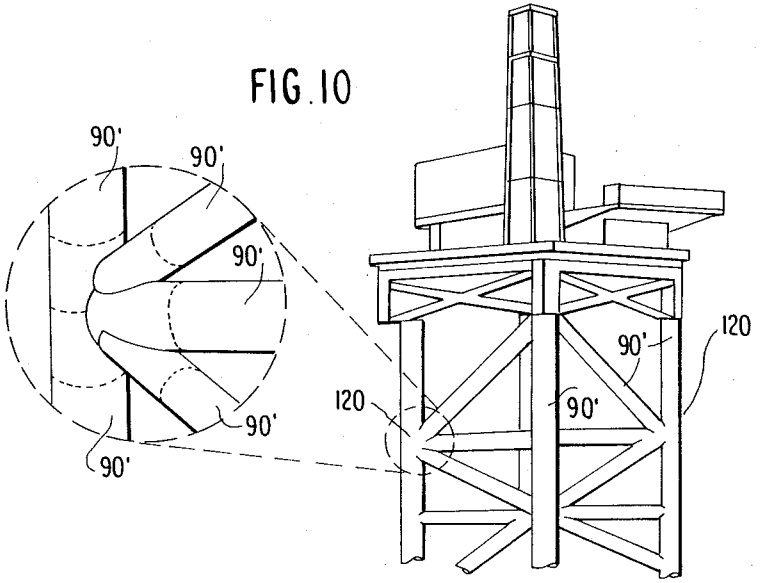
FIG. 10 illustrates an off-shore structure, the balloon enlargement being of a typical node construction.

An automated pipe coating system is shown in FIG. 9. A pipe 90, which in this case is a large diameter structural tube for constructing an off-shore rig, such as shown in FIG. 10, has the lateral ends 90L and 90R supported by a pair of spaced rollers 91L, 91L2 and 91R, and 91R2 (91L2 and 92R2 are not seen in FIG. 9) which are journeled in clevice brackets 92L, 92L2 and 92R, 92R2, which in turn, are supported on spaced I-beams 93 and 94, respectively. Motor 95 is drivingly coupled to rear roller 92R2 to rotate same to thereby rotate pipe 90. End stop rollers 96 on pedestals 97 at each end of the pipe preclude lateral shifting of the pipe.

The I-beams 93 and 94 may serve as guide rails for (1) automated spraying of the pipe with a resin layer 98 to a uniform thickness and coverage, (2) spraying the uncured or wet resin with hollow spheres or beads and (3) guiding a grit-blasting unit for the cured, hollow sphere or beads saturated resin layer or coating 98 to form the matrix of undercuts, nooks and crannies, and (4) guiding the thermal metal spray apparatus as shown in FIG. 9.

Carriage 100 has a small variable speed reversible motor 101 drivingly coupled by a reduction gear (not shown) to drive wheel 102 which engages the web portion of I-beam 93. Power and controls for motor 101 are coupled via cables 103 from control panel 104. Thus, spray gun 106 as well as the spacing from the work surface can be controlled from a computer in which the shape has been stored so as to assure uniform spacing of gun 106 (or other automated spray or surface treating apparatus) at all points of the work surface.

Alternatively, an inexpensive ultrasonic ranging system, as is found on Polaroid TM type cameras can be used to monitor or gauge and control the distance of thermal spray gun 106 from the work surface to thereby assure a more uniform application of metal at the desired areas, it being appreciated that in some areas differentials in metal thickness is desired.

Carriage 100 can be moved back and forth along the guide rails 93 or 94 at any desired or selected speed. The upper surface 105 of carriage 100 serves as a platform on which a resin applyer such as a roller or sprayer, microsphere sprayed, such as shown in FIGS. 3 and 4, a grit-blast or abrader, or a thermal metal spray gun apparatus 106, as shown in FIG. 9 can be carried. Conventional thermal metal spray gun 106 is of the type in which the heat of oxyacetylene gases (the two gases being supplied via lines 107 and 108) melts copper or copper/nickel wires drawn from reels 109 and 110 by feed rolls 111 and 112 respectively. The gun 106 is mounted on a standard 113 which has a base 114 which includes a toothed pinion (not shown) engagable with rack 115. Rack 115 is secured to the upper surface 105 of carriage 100 so gun 106 can be moved laterally of the direction of travel of carriage 100 to thereby adjust the distance between spray gun 106 and the surface of pipe 98. Power cables and gas hoses 116 lay in open topped through 117 which runs parallel to guide rail 93.

Standard 113 can be made of two telescoping members, or include a rack and pinion arrangement for adjusting the height of gun 106 relative to the work surface. If the work surface is planar, rotation, of course, is not necessary. If the surface is a complex surface, separately controllable drives for adjusting the(1) aiming angles, (2) height, and (3) distance of gun 106 from the work surface can be used and controlled from a computer.

The off-shore tower 120 shown in FIG. 10 has been constructed using structural steel pipes 90' which have been coated in the manner shown in FIG. 9 and described herein. The ends 90R and 90L have been left free so that they may be welded at butt ends and nodes, such as node 120 which is shown enlarged in the balloon. After welding of the ends of the structural pipes at node 120, the coating with resin, microsphere spraying, resin curing, grit-blasting and thermal spraying are done, the small corners and angles being easily reached by the spray coatings. The strong mechanical bond achieved through the matrix of undercuts, nooks and crannies formed by the ruptured microspheres assures many years free fouling by marine life. Portions of the surface which may have been damaged in shipment or erection are easy to touch-up and repair. Thus, the invention solves the problem of sheathing complex structural weld configurations of nodes for years of antifouling protection.

Figure 11:
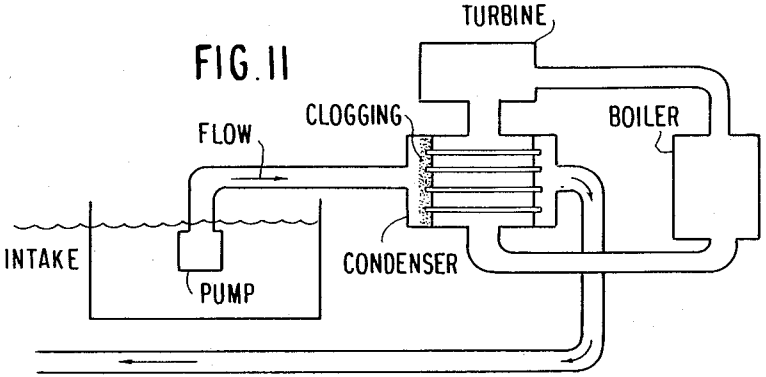
FIG. 11 illustrates a typical cooling water system for a power plant.

The common problems of coastal power plants are the fouling of circulating water systems condenser tube leading to blockage as shown in FIG. 11, and reduced cooling water flow through the system, resulting in lowered efficiency and increased maintenance cost. Present solutions to these problems are clorination, thermal and hydraulic methods, conventional antifouling paints as well as the use of copper/nickel pipe. The present invention is economical and ecologically acceptable for power plant areas such as intake basins, and intake and discharge conduits. Thermally sprayed copper/nickel coatings according to the invention are mechanically locked to the surface and hence are strong and durable. Thick coatings reduce the problem of long term erosion of the material due to heavy water flow.

Electronic, radio and radar housings and other electronic housings and structure require electromagnetic interference (EMI) and radio frequency interference (RFI) shielding. Currently paints, thermally sprayed zinc and aluminum, copper screen and fine mesh have been and for reflection and/or absorption of these radiations. In FIG. 12*a* a room or building 125 has had the walls 125-1, 125-2, 125-3, 125-4, ceiling 126 and if required, the floor 127 coated with copper. The initial layer 128 is an epoxy resin layer; the second layer 129 is the epoxy layer which has been sprayed with microspheres: the third layer 130 is the abraded microspheres which provide the matrix of undercuts, nooks and crannies: and the final element is the thermally sprayed copper layer 131. One or more copper ground wires conductors 132 connects each surface to ground. In FIG. 12*b* a roof 135 has had a copper coating applied, the peel back components having prime members corresponding to the elements of FIG. 12*a*. FIG. 12*c* shows one example of a cornice 136 or decorative trim which has been treated according to the invention. FIG. 12*e* shows a sheet of plywood and/or composite structures (fiberglass skin and honeycomb or masonite, etc.) which has been treated according to the invention. FIG. 12*e* shows a sculpture f which has been treated according to the invention.

The invention can be applied to concrete, brickwork, wood plasters, masonry, fiberglass, polyurethane foams. etc.

There has been recent work by the U.S. Navy at its David Taylor U.S. Naval Ship Research and Development Center in Annapolis to metallize the surface of carbon fiber condenser tubes in order to attach copper cooling fins. Carbon fiber tubes are light in weight and thus in certain applications reduce weight above the water line and permits higher cooling water velocities. Fins are required to improve heat transfer. The present invention provides a solution to the problem of securing or forming fin radiating elements to heat exchange tubes.

In FIGS. 13*a*–13*g*, the cooling fins are applied to a carbon or other exotic material to a carbon fiber tube 1 by applying and abrading the coat 141 and thermally spray with a thin copper coating (0.005") (FIG. 13*b*). The thin copper coating is smoothed and/or ground and then plated with tin (FIG. 13*c*) and thereafter, a series of tin plated copper grommets - fins 150 (FIGS. 14*a* and 14*b*) are assembled on the tin plated surface (FIG. 13*d*) and then fluxed and soldered (FIG. 13*e*). If necessary, a close fitting copper manorel (not shown) is inserted into the I.D. of the tube and the assembly is heated with an induction coil 154 (FIG. 13*f*) or dipped in a hot oil bath 155 (FIG. 13*g*) to flow the solder between the tin plated copper layer and the tin plated copper fins. Enlarged sectional views are shown in FIG. 15 with exemplary dimensions shown in FIG. 15. In the case of FIG. 15, the fins are L-shaped (in cross-section) to achieve a better heat transfer relation between the copper coating and the fins.

Advantages over the present state of the art are as follows:

1. The coating is a continuous coating of complete 100 percent antifouling material without the need of a binder as in regular paints or coatings.

2. The coating, being metal (copper and copper-nickel alloys) is stronger than paints and will not wear or erode as quickly, especially around bow and rudder sections.

3. The coating is very ductile from the very nature of the material, i.e., copper, and will not degrade or become brittle with age as in the case of degradation of organic binders.

4. It is easy to apply, since it is sprayed and does not require careful tailoring for curved surfaces and powders and wires are more economical than the adhesive coated copper-nickel foils.

5. On copper-nickel hulls of two Gulf Coast shrimp boats, the average erosion was approximately 0.05 mil/yr. These are fast moving commerical fishing craft. Slower moving sailing and pleasure craft hulls are conservatively expected to erode at less than ½ mil/yr. Therefore, a coating of 6 to 8 mils should conservatively last at least 12 years. Present intervals for hauling, scraping, and painting depend on water temperature, usually averaging at least once a year.

6. Repairs can be easily made by lightly grit-blasting the damaged area, applying the resin and microspheres and abrading and spraying an overlapping coat of copper/nickel alloy. To speed up such repairs, the resin can be a U.V. resin which cures more rapidly under ultraviolet exposure.

7. The copper/copper-nickel alloys present considerably less toxicity and handling problems in comparison to the complex organotin compounds.

8. Hydrodynamic design of hull surfaces are not changed.

9. Since the copper/copper-nickel coatings are relatively thin, flexible, and strongly adherent to the outer hull surfaces by the mechanical interlocking of the metal when it solidifies in the undercuts, nooks and crannies 13, they flex with flexture of the hull and strongly resist delamination forces thereby assuring a longer life.

10. The unfractured or intact spheres provide an insulating function, or conductive depending on the composition of micronsphere chosen.

11. The coating has high "scrubability" as compared to paints since it is metal and not an organic material.

The density of the spray deposits are not as dense as a wrought material such as a foil or plate, so there is a larger microscopic surface area present in the form of cupurous oxide per given area and hence will expose a more hostile surface to marine organisms.

The basic improvement in this invention is the increased strength of the bond between the metal coating and the substrate surface and this comes about through the formation of the matrix of undercuts, nooks and crannies for receiving the liquid coating, preferably molten metal particles, the undercuts, nooks and crannies being formed by fracturing or rupturing the micronsized glass or ceramic spheres which have been sprayed upon the outer surface of the cured resin carrier.

While the invention has been described with reference to the antifouling treatment of copper and copper alloys or marine surfaces, the invention in its most basic aspect is applicable to cladding materials in general, and particularly metals, and more particularly copper, on any substrate surface.

While there has been shown and described the preferred practice of the invention, it will be understood that this disclosure is for the purpose of illustration and various omissions and changes may be made thereto without departing from the spirit and scope of the invention as set forth in the claims appended hereto.

What is claimed is:

1. In a method of applying an antifouling coating to a marine surface of a metal selected from the group comprising copper and/or copper alloys—such as copper-nickel, the improvement comprising the steps of:

(1) coating said marine surface with a curable adhesive resin, (2) spraying a layer of inorganic hollow spheres in the size range of greater than 10 microns onto said adhesive resin prior to curing of same, (3) curing said curable layer, (4) after step (3), abrading said layer of hollow inorganic spheres to fracture same and produce a matrix of anchor sites, undercuts, nooks and crannies in the surface thereof, and (5) thermally spraying molten metal particles on said matrix to fill said undercuts, nooks and crannies with said metal in one or more passes thereof.

2. The method and system of applying an antifouling coating as defined in claim 1 wherein the step of (2) spraying includes placing an electric charge on each inorganic hollow sphere, and electrically attracting the charged hollow spheres to the surface of said curable layer.

3. The invention defined in claim 1 wherein step (2) spraying said resin adhesive with a layer of inorganic hollow spheres is carried out by spraying said spheres upon said adhesive resin in a size range of about 10 to 300 microns to fill said resin.

4. The invention defined in claim 1 including spraying said hollow spheres onto said curable adhesive resin until said uncured adhesive has a dull matte like finish, and recycling of sprayed hollow spheres which did not adhere to said adhesive resin.

5. The invention defined in claim 1 wherein in step (1) the adhesive is a U.V. sensitive resin and including subjecting same to U.V. to cure prior to abrading.

6. The invention defined in claim 1 wherein said hollow spheres are in a proportion of 100–250 percent by volume.

7. The invention defined in claim 1 wherein in step (1), the hollow spheres are glass or ceramic and are in a size range of about 10 to 300 microns.

8. The invention defined in claim 7 wherein said hollow spheres are of different sizes.

9. A marine surface formed by any one of the methods defined in claims 1–8.

10. A method of rigidly securing a metal layer to a substrate surface comprising:

(1) applying a curable adhesive layer to said substrate surface;

(2) spraying at least a layer of hollow beads in a selected size range to said curable adhesive layer;

(3) then curing said curable adhesive layer;

(4) fracturing at least the ones of said hollow spheres secured on the exposed surface by abrading away at least a portion of the hollow bead surface to form an exposed matrix of undercuts, nooks and crannies in said matrix;

(5) spraying molten metal into said exposed undercuts, nooks and crannies to form said metal layer.

11. The invention defined in claim 10 wherein said hollow beads range in size from about 10 to 300 microns.

12. The invention defined in claim 11 wherein said hollow beads comprise 100–250 percent by volume of said matrix system when applied.

13. The invention defined in claim 10 wherein said matrix comprises an epoxy resin and a plurality of ruptured micronsized beads selected from the group consisting of hollow glass or ceramic or ceramic beads or a mix thereof.

14. A substrate surface having a metal layer formed according to any one of the methods defined in claims 10–13.

15. A method of improving the mechanical adherence between two materials, comprising:

(1) spraying a plurality of small sized frangible hollow beads in one of said materials, while said one of said materials is in a liquid state;

(2) solidifying said one of said materials;

(3) rupturing the surface ones of said frangible hollow beads to form undercuts, nooks and crannies;

(4) flowing the other of said materials in a molten state into said undercuts, nooks and crannies; and (5) solidifying said other of said materials.

16. The method defined in claim 15 wherein the first one of said materials is sprayed upon a forming surface, said frangible hollow beads are selected from the group consisting of glass and, ceramic or carbon and are ruptured by abrading, and said other of said materials is a molten metal that is sprayed upon said one of said materials and said undercuts, nooks and crannies.

17. A method of metal cladding a surface comprising;

(1) applying an adhesive layer to said surface;

(2) spraying a layer of hollow glass or ceramic or carbon micron size spheres or a mix thereof to said adhesive layer;

(3) curing said adhesive layer after spraying on of said spheres;

(4) rupturing at least the surface ones of said spheres to produce a matrix of undercuts uniformly over said surface; and (5) thermally spraying metal in molten particle form applying upon said matrix to fill said undercuts, nooks and crannies with molten metal which flows into and conforms to the surfaces of said undercuts.

18. The method defined in claim 17 wherein in step (2), said spheres are sprayed until said uncured adhesive has a dull matte like and unshinny apperance.

19. A building structure having a metal cladding applied according to the invention defined in claim 17 or 18.

20. A sculpture having a metal cladding applied according to one of claim 17 or 18.

21. A composite panel having a metal cladding applied according to one of claims 17 or 18.

22. The method of metal cladding a surface as defined in claim 17 wherein the step of (2) spraying a layer of hollow glass or ceramic or carbon micronsize spheres includes placing an electric charge on each sphere and electrically attracting the charged spheres to the surface of said adhesive layer prior to step (3).

* * * * *